United States Patent [19]

McDaniel

[11] 4,361,916

[45] Dec. 7, 1982

[54] PEDIATRIC TABLE-CHAIR

[76] Inventor: William L. McDaniel, 6711 SW. 26th Ct., Miramar, Fla. 33023

[21] Appl. No.: 141,308

[22] Filed: Apr. 18, 1980

[51] Int. Cl.[3] ..... A61G 7/00; A61G 7/06

[52] U.S. Cl. ..... 5/62; 5/509; 5/66

[58] Field of Search ..... 5/60, 62, 66, 67, 68, 5/509, 508; 108/1, 6

[56] References Cited

U.S. PATENT DOCUMENTS

| | | | |
|---|---|---|---|
| 2,035,321 | 3/1936 | Koenigkramer et al. | 5/60 UX |
| 2,295,006 | 9/1942 | Philips | 5/62 |
| 3,111,181 | 11/1963 | Yatich | 5/67 X |
| 3,293,667 | 12/1966 | Ohrberg | 5/60 X |
| 3,609,779 | 10/1971 | Oja et al. | 5/62 |
| 3,997,926 | 12/1976 | England | 5/62 |

FOREIGN PATENT DOCUMENTS

| | | | |
|---|---|---|---|
| 163976 | 7/1955 | Australia | 5/67 |
| 1083290 | 1/1955 | France | 5/67 |
| 581991 | 11/1976 | Switzerland | 5/67 R |

*Primary Examiner*—Stephen J. Novosad
*Attorney, Agent, or Firm*—Malin & Haley

[57] ABSTRACT

A pediatric table-chair which allows for multiple positioning of a body support platform when in its functional position or for folding when not in use. The table has a body support platform which has an upper end pivotally connected to two rigid supporting members and has the lower end pivotally connected to a telescopically variable support. The other ends of the two rigid supporting members and the telescopically variable support are pivotally connected to a center support of a sectional base. The base is supported by wheels which allow mobility of the device. Also pivotally attached to the base is a folding handle. There are two horizontal braces, one end of each which is pivotally connected to the folding handle, the other end of each which is pivotally connected to a respective rigid supporting member. The brace also provides a support for a rear utility tray when the device is in the functional position. A detachable head rest, foot rest and front utility tray can be added to the body support platform as needed. A strap, which secures the torso to the platform and another strap which secures each leg to the body support platform may also be added as needed. Additional straps may be added for additional handicaps, i.e. head strap for child with no head control, etc.

8 Claims, 7 Drawing Figures

PEDIATRIC TABLE-CHAIR

BACKGROUND OF THE INVENTION

The present invention relates to variable positionable tables and chairs, and more particularly to such tables and chairs adapted for the use of caring for children who are rendered invalid in the lower torso and legs by a body cast or other disease which causes inflexibility of the legs.

In the past, tables and chairs have been constructed in such a manner as to accommodate primarily the average person, be it adult or child, with normal dexterity with his or her legs. The design of these tables and chairs require the user to process mobility not capable of being performed by children who are rendered invalid in the lower torso and extremities by a full body cast or disease which renders their legs inflexible but has use of either or both of his arms. On the other hand, inventions specifically designed for carrying invalids have generally been functional for transporting adult invalids and providing very limited facility for any activities which the invalid may be physically capable of performing. The present invention overcomes the limitations of the prior art by providing a self-contained device which creates an environment in which the occupant, who must spend the majority of his or her waking hours in the device, may take full advantage of whatever faculties he or she may possess and be conveniently transported as desired.

A body support platform which can be adjusted from a horizontal position to a completely standing position and any position inbetween, in conjunction with a stationary rear utility tray directly behind the head end of the body support platform, and adjustable front utility tray is uniquely employed.

The occupant may be placed on the body support platform either on his stomach or on his back. While laying on his stomach with headrest removed, the occupant has full access to the rear utility tray with his arms, which allows the occupant to use the articles on the tray or to feed himself. The body support platform may occasionally be adjusted to change the location of pressure points on the body.

Various types of tables, chairs, and invalid beds are known in the prior art. One such invalid bed is discussed in U.S. Pat. No. 1,709,137 in which a sectional body frame having the several sections joined together and mounted on a pedestal in such a manner as to allow for adjustment of the various positions is employed. The various positions include only those related to sitting or laying down but not standing. Another table-like device is described in U.S. Pat. No. 2,646,735. The baby poser consists of structure for supporting an infant baby in the prone position for photography purposes. The supporting platform is adjusted by changing position of a headed rod which passes through one set of vertically disposed sets of holes on both sides of the upright. This necessitates removal of the headed rod from the upright when changing positions. Another table-like device is described in U.S. Pat. No. 2,787,509 and is shown as a work table with tilting table tops. The tilting table top is primarily designed for packaging and discharging of goods. The package starting initially in a horizontal position on the table top is discharged by allowing the downward movement of the table top about a fulcrum point caused by the weight of the package, which requires the center of gravity to be towards the end of the table.

The present invention by being particularly designed for use by an invalid child, immobile in the lower torso and legs, overcomes the impracticalities of these other devices not designed specifically for such invalid children. By providing a movable body support platform pivoting from the head end and a telescopically variable support emanating from the base of the invention, a rear utility tray horizontally positioned directly behind the head end of the body support platform and an adjustable front utility tray positioned in front of the body support platform to which it is attached, the device allows maximum movement of the upper torso and extremities of occupant for use of articles placed on either the rear utility tray or front utility tray and frequent adjustment of the angle of the body support platform without taking the occupant off the platform or relying on occupant's weight to move the platform. Futhermore, the body support platform allows the occupant to be placed in a standing position. The pediatric table-chair may also be folded when not in use for storage.

SUMMARY OF THE INVENTION

The invention disclosed herein is a multi-positional, portable, folding table-chair for caring for children who are invalid. When in the unfolded position, a body support platform is exposed. The body support platform supports the body of the child and can be rotated from a laying, horizontal position to a standing, vertical position.

Rotation of the body support platform is accomplished by pivotally attaching each corner of the top end of the platform to one end of a rigid support. The other end of each rigid support is in turn pivotally connected to a side of a sectional base.

The sectional base is supported by two swivel mounted wheels attached on each corner of the front of the base and by two fixed mounted wheels on each corner of the back section which allow mobility of the invention.

At the rear of the platform is a folding handle pivotally attached to each corner of the base. Each side of the handle is further supported by a rigid, horizontal brace one end which is pivotally connected to the handle, the other end which is pivotally attached to the rigid support of the main platform. Rigid horizontal braces additionally provide support for a removable rear utility tray.

A detachable front utility tray, headrest and foot rest can also be used when desired as well as straps to secure the torso and each leg to the body support platform.

The primary object of this invention is to provide a versatile, multi-positionable table-chair to allow for the frequent repositioning of an invalid child which is critical to his care.

It is another object of this invention to provide a multi-positionable table-chair which can be folded for storage or when not in use.

It is still another object of this invention to provide a multi-positionable table-chair which can be moved from room to room with an occupant thereon without carrying the table-chair.

It is a further object of this invention to provide a multipositionable table-chair with a front and rear utility tray which can be used to hold items necessary to occupant's care.

A still further object of this invention is to provide a table-chair which has a detachable head rest which can be removed if necessary.

The final object of this invention is to provide a table-chair which has a detachable foot rest which can be removed if necessary.

In accordance with these and other objects which will be apparent hereinafter, the instant invention will now be described with particular reference to the accompanying drawings.

DETAILED DESCRIPTION OF THE PREFERRED EMBODIMENT

Figure 2:
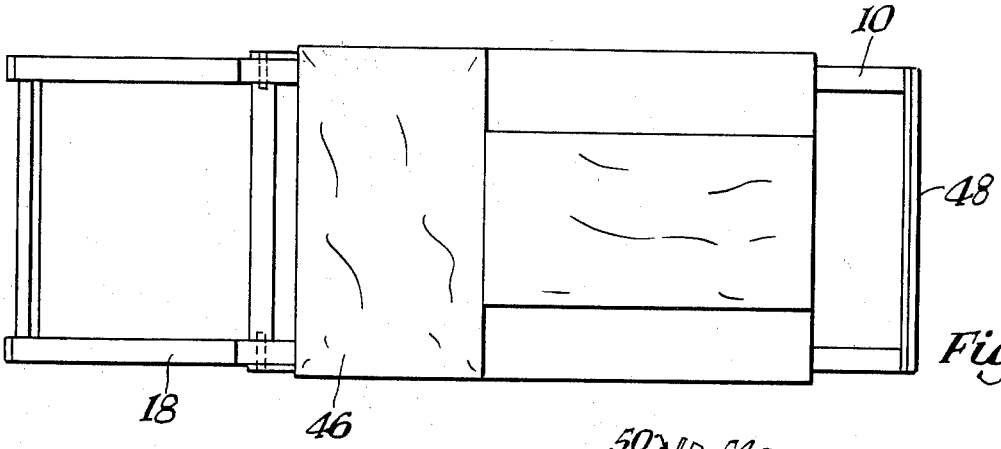
FIG. 2 is a top elevational view of the pediatric table-chair.
Figure 1:
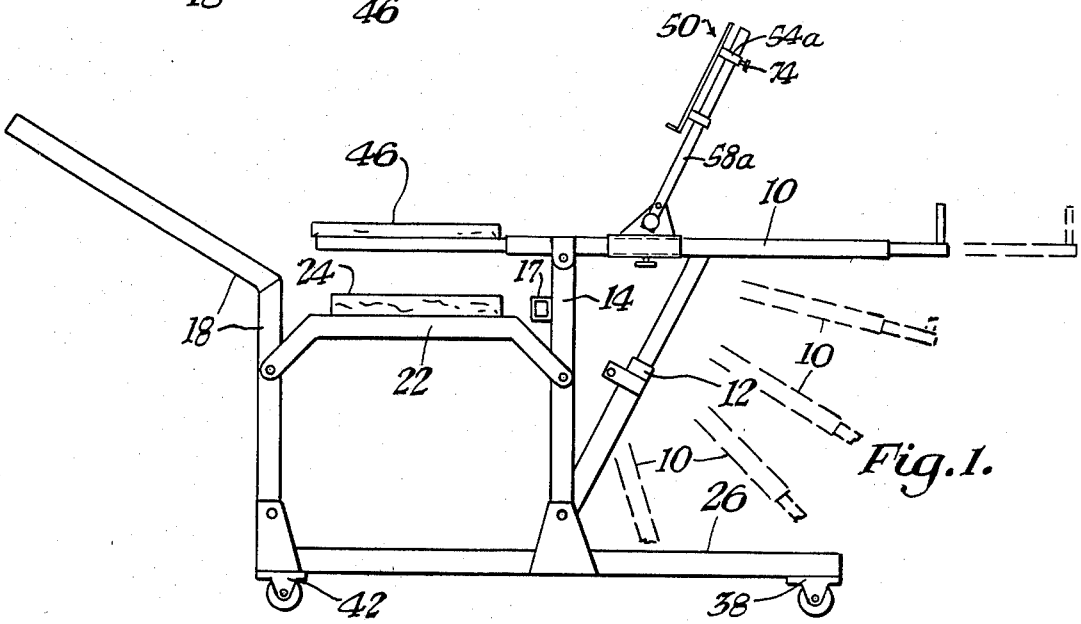
FIG. 1 is a side view of the pediatric table-chair in its unfolded functional position with the body support platform in a horizontal position.
Figure 3:
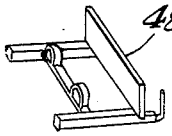
FIG. 3 is a front view of the pediatric table-chair in its unfolded functional position with the body support platform in a horizontal position.
Figure 3:
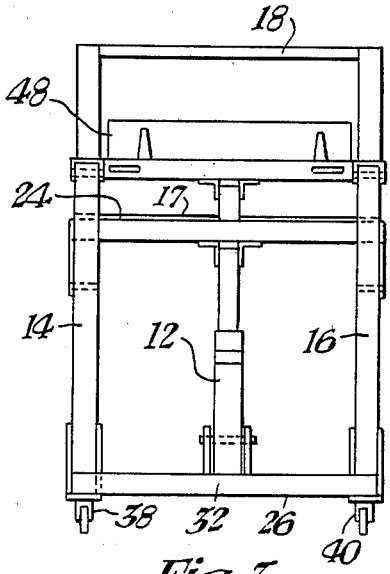

Referring to FIG. 1, the pediatric table-chair is comprised of a body support platform 10 which is pivotally attached to a rigid support member 14 and a rigid support member 16, as shown in FIG. 3. The bottom portion of the body support platform 10 is pivotally attached to an adjustable telescoping support member 12. Thus, the body support platform 10 can be positioned in any position from horizontal to substantially vertical by adjusting the adjustable telescoping support member 12.

Figure 5:
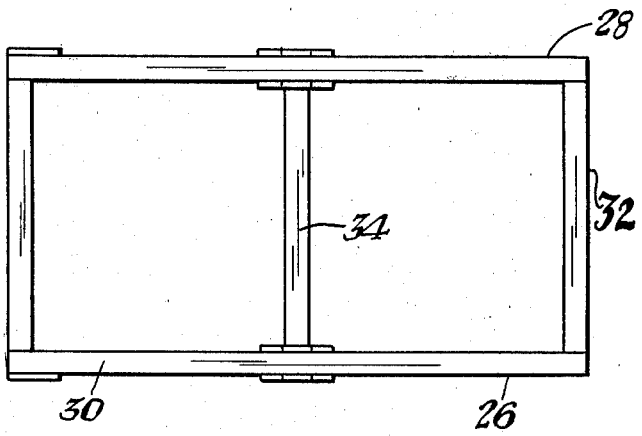
FIG. 5 is a top elevational view of the base of the pediatric table-chair.

The rigid support members 14 and 16, shown in FIG. 3, are pivotally attached to respective sections 28 and 30 of the base 26, as shown in FIG. 5. A rigid cross support 17 is fixed to the rigid support members 14 and 16 to maintain a fixed distance between the rigid support members 14 and 16 and to provide additional support.

The adjustable telescoping support member 12 is pivotally attached to the center support 34, shown in FIG. 5, of the base 26 to allow rotation of the adjustable telescoping support member 12 about an axis parallel to the center support 34 when the position of the body support platform 10 is changed.

A folding handle 18 having one side pivotally attached to section 28 of base 26 and the other side of the handle 18 being pivotally attached to section 30 of the base 26, sections 28 and 30 being shown in FIG. 5, is used to push the pediatric table-chair from one location to another.

Figure 4:
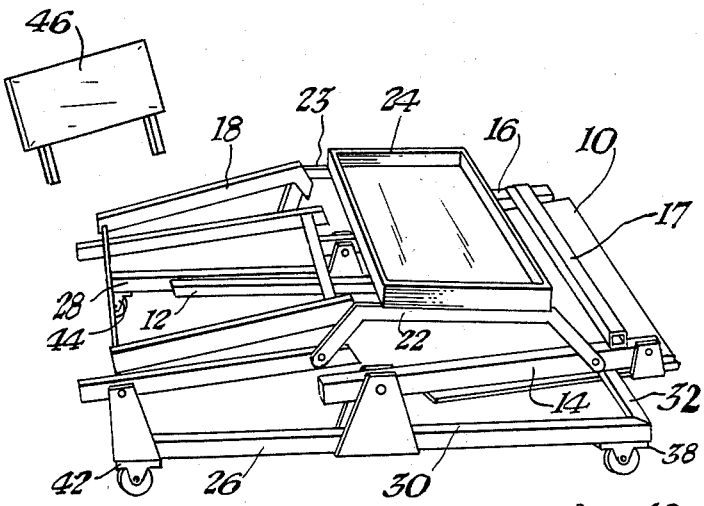
FIG. 4 is a side elevational view of the pediatric table-chair in a folded position with the head rest and foot rest removed.

A rear utility tray support 22, having one end pivotally attached to the folding handle 18 and the other end pivotally attached to a rigid support member 14 and a like rear utility tray support 23 shown in FIG. 4, between the other side of the folding handle 18 and the other rigid support member 16, not only support the folding handle 18 in a fixed relation to the rigid supports 14 and 16 shown in FIG. 3, but also support a rear utility tray 24 which can be used by the occupant of the body support platform 10 to hold numerous types of articles.

Figure 7:
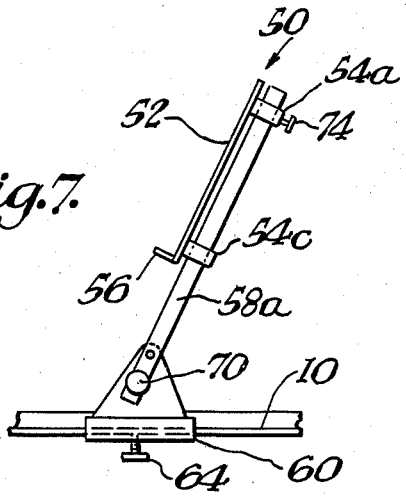
FIG. 7 is a side view of the adjustable front utility tray of the pediatric table-chair.
Figure 6:
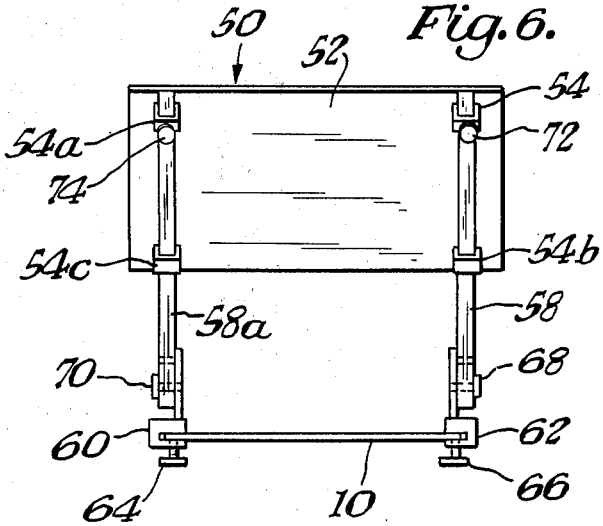
FIG. 6 is a front elevational view of the bottom side of the front utility tray.

Referring to FIGS. 6 and 7, the adjustable front utility tray assembly 50 is slidably mounted to the body support platform 10 by the brackets 60 and 62. The brackets 60 and 62 are held in place by the set knobs 64 and 66. The front utility tray assembly further comprises two rigid support posts 58 and **58*a*, which are swivelly mounted to a respective bracket 60 and 62. The angle of the front utility tray assembly 50 can be varied by disengaging the pull release pins 68 and 70, changing the position of the assembly 50 and then releasing the pull release pins 68 and 70, allowing engaging of the pins 68 and 70 with the respective brackets 60 and 62. The front utility tray 52 of the front utility tray assembly 50 is slidably mounted to the respective rigid support posts 58 and 58*a* by the connectors 54, 54*a*, 54*b*, and 54*c*. The front utility tray 52 is locked into the desired position along the rigid support posts 58 and 58*a* by the additional set knobs 72 and 74. A lip 56 can also be added to the bottom edge of the front utility tray 56** to hold such things as books and pencils in place.

One fixed mounted caster wheel 42, as shown in FIG. 4, is fixed to the rear corner of section 30 of the base 26 and another fixed mounted caster wheel 44 as shown in FIG. 4 is fixed to the rear corner of section 28 of the base 26. One swivelly mounted caster wheel 38 is attached to the left corner of the front section 32 of the base 26, as shown in FIG. 3 and another swivelly mounted caster wheel 40 is attached to the right corner of the front section 32 of the base 26, also shown in FIG. 3, to steer the pediatric table-chair when being pushed. A head rest 46 with a padded cushon 46 can be slidably mounted to the body support platform 10 to provide support for the occupant's head. A foot rest 48 can be slidably mounted to the lower end of the body support platform 10 to support the occupant's lower extremities.

FIG. 4 represents the pediatric table-chair in a folded position. The telescoping support member 12 is loosened and the upper section slidably removed from the lower section. This allows the lower end of the body support platform 10 to be rotated toward the rear of the device about the pivot points of the rigid support members 14 and 16. With the telescoping support member 12 disconnected, the two rigid support members 14 and 16 are rotated about the pivot points on the respective sections 30 and 28 of the base 26 toward the front of the device. This in turn causes the rear utility tray supports 22 and 23 to pull the folding handle 18 toward the front of the pediatric table-chair and rotate toward the floor about the points where the utility tray supports 22 and 23 are attached to the respective legs of the folding handle 18. The folding handle 18 can be further folded about pivot points at the mid point of each leg of the folded handle 18. The pediatric table-chair is then ready for storage.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A pediatric table-chair comprised of:

a base;

at least one rigid support member each said rigid support member with a lower end connected to said base;

a body support platform including an upper portion and a bottom portion, said body support platform pivotally connected to said body support platform pivotally connected to said rigid support member to move said body support platform between a horizontal position and a substantially vertical position;

an adjustable support means, the lower end of said support means connected to said base, said support means for supporting said body platform in various positions;

a utility tray connected to said rigid support member;

removable headrest support means connected to said body support platform, said headrest support means removable to provide functional access to said utility tray when a patient is supported facing said body support platform while the patient's head and hands are free to use said utility tray;

support means connected to said body support platform, said support means for preventing downward movement of the trunk of the user when said body support platform is in a downwardly sloping position.

2. The pediatric table-chair as described in claim 1, including:

a front utility tray assembly connected to said body support platform.

3. The pediatric table-chair as set forth in claim 2 including:

caster wheels connected to said base.

4. The pediatric table-chair as set forth in claim 3 including:

a handle means connected to said base for pushing or pulling said pediatric table-chair.

5. The pediatric table-chair as set forth in claim 1 wherein:

said support means includes a footrest and at least one strap to secure the torso to said body support platform.

6. A pediatric table-chair comprised of:

a base;

at least one rigid support member each said rigid support member with a lower end connected to said base;

a body support platform including an upper portion and a bottom portion, said rigid body support platform pivotally connected to said support member to move said body support platform between a horizontal position and a substantially vertical position;

each said rigid support member including connecting means for collapsing each said rigid support member and said body support platform onto said base;

an adjustable support means, the lower end of said support means connected to said base, said support means for supporting said body platform in various positions;

a utility tray connected to said rigid support member;

removable headrest support means connected to said body support platform, said headrest support means removable for use of said body support platform to support the front of the trunk of a patient while the patient's head and hands are free to use said utility tray; and support means connected to said body support platform, said support means for preventing downward movement of the trunk of the user when said body support platform is in a downwardly sloping position.

7. The pediatric table-chair as set forth in claim 6 wherein;

said connecting means includes a bracket connected to said base and having a pin therethrough;

said pin disposed through said rigid support member to allow pivotal movement of said rigid support member.

8. A pediatric table-chair comprised of:

a base;

at least one rigid support member each said rigid support member with a lower end connected to said base;

a body support platform including an upper portion and a bottom portion, said support platform pivotally connected to said rigid support member to move said body support platform between a horizontal position and a substantially vertical position;

an adjustable support means, the lower end of said support means connected to said base, said support means for supporting said body platform in various positions;

a utility tray connected to said rigid support member;

removable headrest support means connected to said body support platform, said headrest support means removable for use of said body support platform to support the front of the trunk of a patient while the patient's head and hands are free to use said utility tray;

support means connected to said body support platform, said support means for preventing downward movement of the trunk of the user when said body support platform is in a downwardly sloping position;

a front utility tray assembly connected to said body support platform;

caster wheels connected to said base; and a handle means connected to said base for pushing or pulling said pediatric table-chair;

said handle means collapsible onto said base.

* * * * *